United States Patent [19]

Mikels

[11] Patent Number: 5,023,852

[45] Date of Patent: Jun. 11, 1991

[54] RESETTABLE GRAVITY TIMER

[76] Inventor: Peter Mikels, 5896 Mikels Rd., Sturgeon Bay, Wis. 54235

[21] Appl. No.: 595,572

[22] Filed: Oct. 11, 1990

[51] Int. Cl.[5] ..... G04F 1/04

[52] U.S. Cl. ..... 368/93

[58] Field of Search ..... 368/93–95

[56] References Cited

U.S. PATENT DOCUMENTS 3,125,849 3/1964 Wachtel ..... 368/93

3,240,007 3/1966 Dock et al. ..... 368/93

4,527,905 7/1985 Kehls ..... 368/93

*Primary Examiner*—Vit W. Miska

*Attorney, Agent, or Firm*—Dowell & Dowell

[57] ABSTRACT

A gravity timer of the hour-glass type having a pair of chambers which communicate through an intermediate portion in which a restrictor valve is normally seated in order to regulate the rate of flow of a granular material therethrough and which valve may be selectively opened so that the granular material contained within one chamber may freely pass to the other chamber.

10 Claims, 1 Drawing Sheet

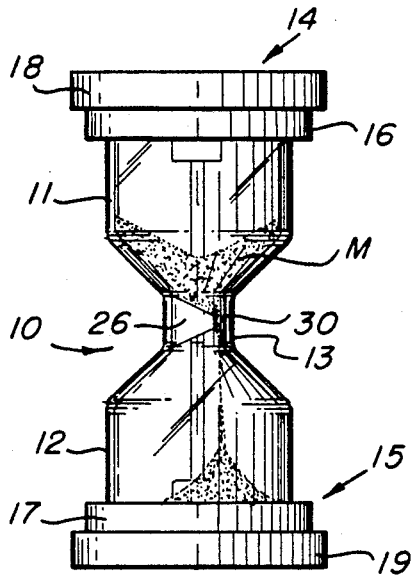
FIG. 1
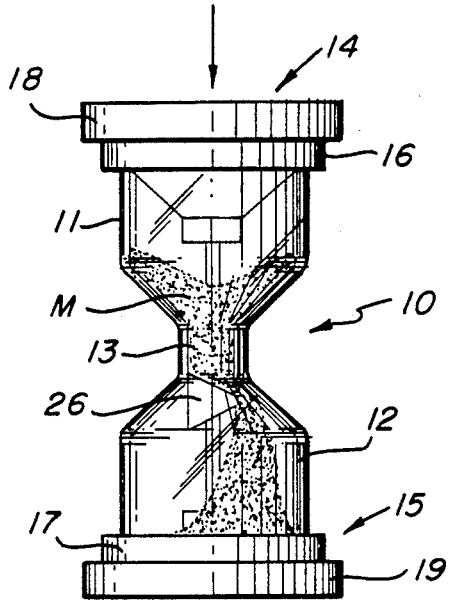
FIG. 2
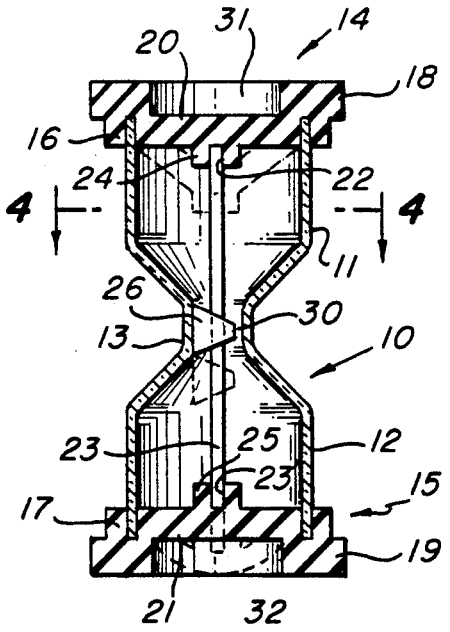
FIG. 3
FIG. 4
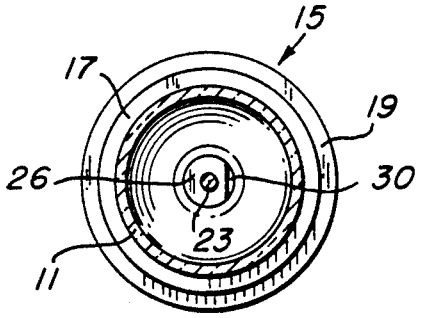
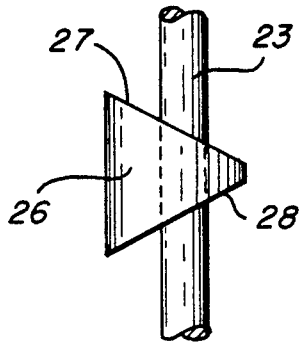
FIG. 5

RESETTABLE GRAVITY TIMER

BACKGROUND OF THE INVENTION

1. Field of the Invention

This invention is generally directed to timing devices and more specifically to gravity flow timers of the type having a pair of chambers which are connected by a restricted throat or valve portion and wherein a freely flowable material passes from one chamber to the other in a predetermined amount of time. The present invention is further directed to gravity flow timers which are resettable by including structure which allows the flowable material to be immediately discharged from one chamber to another so that the timing cycle of the timer is immediately established. The timing devices of the present invention are primarily designed for use in game situations.

2. History of the Related Art

There are currently many games available to consumers which are regulated by timing the sequence of play between each of the various players so that a move or action must be taken within a predesignated amount of time. The sophistication of timing devices utilized with games depends upon the specific environment in which the games are to be played. For instance, in competition tournaments for chess each move of a player is controlled by electronic equipment. On the other hand, in home games wherein players must make a move or answer a question in a specified amount of time, reliance is more generally based upon mechanical or conventional gravity type timers. The most economical of the timers for use in conventional board and card games are gravity timers which are of an hour glass configuration. During play, timing is initiated by inverting the hour glass so that material will flow from an upper chamber to a lower chamber through a restricted orifice or neck portion. Such timing devices are designed to give a predetermined amount of time for a player to take an action, answer a question or make a play. Unfortunately, in many instances a player acts before time has expired and therefore the next player in sequence must await the completion of the timing cycle before additional play is possible. In some instances the delay in game play can be an annoyance to the players or may have the effect of decreasing the degree of concentration or level of excitement exhibited by the players.

In an effort to overcome the problems exhibited by conventional hour-glass type timers, there have been several structures proposed for allowing gravity timers to be reset. In Wachtel U.S. Pat. No. 3,125,849 a timing device is disclosed which incorporates a pair of chambers which are connected by an intermediate valve. The valve is rotatable so as to selectively align two different channels with the chambers. One of the channels is considered the timing channel while the other channel, which is of a larger dimension, is used as a reset channel. When the valve is turned so that the reset channel is aligned with the two chambers the flow rate of material is increased so that the timing device may be set in an expedited manner. Unfortunately, with this device it is necessary to provide an intricate valve mechanism between the two chambers. The additional structure requires that the valve be sealed relative to the chambers so that no material will wedge between the housing of the timing device and the rotary valve. These complications increase production costs and therefore, such timers would not be conducive for use in a conventional home game.

Other resettable timers have been developed which require no moving parts. In Johnson U.S. Pat. No. 4,813,030 a resettable timer is disclosed which includes a housing having an inner baffle system wherein the baffles creates a first restricted flow channel relative to the housing along one side thereof and secondary less restricted flow channels along the remaining sides of the baffles and housing. By rotating the housing the material contained therein flows around the baffles to its initial starting point. Unfortunately, with this type of structure, a step-by-step rotation of the housing is required in order to bring all the flowable material to a common chamber. This means that an individual must first rotate the device 90° and thereafter allow the material to move to a first position, thereafter rotating again another 90°, with this process continuing until all of the material is within a common chamber above the first flow channel.

Some additional examples of prior art gravity flow timing devices are disclosed in U.S. Pat. Nos. 2,144,857 to Schultz; 4,431,313 to Hemperly; French patent 1,435,742; West German patent 2,255,154 of 16 May 1974; and British patent 23,894 of 13 Dec. 1893.

SUMMARY OF THE INVENTION

This invention is generally directed to a timing device of the gravity flow type wherein a granular or other freely flowable material flows from a first chamber and through a restrictor valve to a second chamber. In a preferred embodiment, the restrictor valve has at least one passageway defined therein through which the material flows between chambers at a controlled and predesignated rate. The valve is axially movable relative to a valve seat defined by the intermediate portion of the timer housing which extends between the first and second chambers so that when the valve is spaced from the valve seat the granular material will immediately pass between chambers by gravity.

To facilitate opening of the valve, an elongated valve stem extends from the valve and into contact with the end walls of the chambers. The chamber end walls are constructed of a flexible and resilient material so that when deflected by the valve stem they will tend to urge the valve back to its fully seated position. In order to protect against the its fully seated position In order to protect against the valve stem being accidentally moved by depression of one of the end walls, the end walls are recessed within supports which extend outwardly and in surrounding relationship thereto. In a preferred embodiment, the supports may be integrally formed with the flexible end walls.

It is the primary object of the present invention to provide a gravity type timer of the type which is particularly useful in timing games of chance and skill and wherein a player is given a predetermined time to accomplish a move, make a play or answer a question and wherein the flowable material in the timer may be quickly released so as to pass immediately from one chamber to another so that the timer is reset for subsequent timing of the activity or play of another player.

It is a further object of the present invention to provide a low cost hour-glass type timer wherein the timer includes a flow control valve which normally regulates the flow between a pair of chambers but which is easily opened to permit an unrestricted flow of material to thereby allow the immediate resetting of the timer.

It is yet a further object of the present invention to provide a timing apparatus which may be inexpensively constructed and yet durable enough to be utilized in game situations including home games wherein a timer is used to regulate the time of play given each player.

It is yet a further object of the present invention to provide a resettable timing device of the hour-glass type wherein the flowable material contained therein may be selectively discharged immediately to an opposing chamber by operating a valve from either end of the timer.

BRIEF DESCRIPTION OF THE DRAWINGS

FIG. 1 is a front elevational view of one embodiment of the timer of the present invention showing the flowable material passing through a restrictor valve from one chamber to another to thereby provide a predetermined timing sequence.

FIG. 2 is front plan view of the timer of FIG. 1 showing the restrictor valve in an open position wherein material from the upper chamber is immediately deposited to the lower chamber.

FIG. 3 is a cross-sectional showing in full line the timer of FIG. 1, and in dotted line the timer of FIG. 2.

FIG. 4 is a cross-sectional view taken along lines 4—4 of FIG. 3.

FIG. 5 is an enlarged side elevational view of the restrictor valve shown in FIGS. 1–4.

DESCRIPTION OF THE PREFERRED EMBODIMENT

With continued reference to the drawings, the timing device 10 of the present invention includes an hour-glass housing having a first chamber 11 and a second chamber 12 which are integrally connected by a restricted throat or intermediate portion 13. Generally, the cross-sectional configuration of conventional hour-glass timers is circular, however other cross-sectional configurations may be utilized. The hour-glass housing is preferably formed of a transparent plastic or glass material so that the contents thereof, such as a freely flowable granular material (M), may be observed as it passes from one chamber to another during a timing cycle. The chambers 11 and 12 are closed at their ends by a pair of caps 14 and 15 each of which is provided with an annular recess 16 and 17, respectively, in which the end portions of the housings 11 and 12 are selectively seated. Each cap 14 and 15 further includes an outer annular flange 18 and 19, respectively, which provide a base for supporting the timing device when in an upright position. Each cap also has a central flexible membrane 20 and 21, which in the preferred embodiment, is integrally molded with the remaining molded of a rubber or other elastomeric material. The membranes 20 and 21 allow a limited amount of resilient deflection as indicated by the dotted lines in FIG. 3.

Each flexible membrane 20 and 21 further includes a centrally oriented sleeve or socket 22 and 23 which oppose one another along a common axis. An elongated valve stem 23 has end portions 24 and 25 which are securely seated and sealed within the sockets 22 and 23. As shown, the valve stem 23 extends through the elongated axis of the hour-glass and includes a valve member 26 generally centrally of its length which normally is seated within the intermediate or throat portion 13 of the timer. The valve member 26 includes tapered upper and lower walls 27 and 28 and an end portion 29 which is spaced from one wall of the throat so as to provide an opening 30 therethrough. The size of the opening determines the normal rate of flow of material through the timer when in use.

With specific reference to FIG. 1, the timer is shown with the flowable material (M) within chamber 11 and flowing into chamber 12 through the opening 30 created by the valve member 26. During normal operation, the timing sequence is predetermined so that a period of, for instance, one to three minutes is necessary for the material in chamber 11 to pass into chamber 12. This one to three minute period therefore sets the time in which an individual must take some action in a game or may be otherwise utilized to regulate time in other situations. The slope provided along the upper and lower portions of the valve 26 aids in directing all of the material through the opening 30, as no material can accumulate along the upper and lower tapered surfaces 27 and 28.

During a timing cycle, should it be desired to reset the timer, it is only necessary to depress either of the membranes 20 and 21 toward the opposing membrane so as to shift the valve 26 into either chamber 11 or 12. Due to the shift the valve 26 into either chamber 11 or 12. Due to the orientation of the membranes, 20 and 21, recesses 31 and 32 are formed wherein the tip of a person's fingers may be easily inserted so as to urge the membranes toward one another. As shown in FIG. 2, when membrane 20 is depressed the valve member 26 will be urged out of the throat 13 and into the lower chamber 12 thereby providing an unrestricted opening through the throat portion 13 and the granular material will thus be able to immediately descend from chamber 11 into chamber 12. Once pressure on the membrane is released, the resiliency of the membranes will automatically shift the valve stem so as to align the valve within the throat 13. Thereafter, the timer is simply inverted so that chamber 12 is above chamber 11 and the timing cycle is again initiated. In the event that a further timing cycle is necessary once the timer has been inverted, it is only necessary to depress the flexible membrane 21 associated with the cap 15 closing off chamber 12 to allow the material (M) to discharge from chamber 12 back into chamber 11.

In some embodiments, it may be preferred to form the cap portions 15 and 16 of a rigid material in an annular or other configuration and thereafter provide a separate flexible material which would be seated relative to the housing chambers 11 and 12 as the cap portions are fitted over the ends of the chambers. Further, the exact configuration of the valve member 26 may be varied.

It should be noted, that in the embodiment shown, the membranes are recessed from the outer edges of the cap members 14 and 15. In some instances, it may be possible to extend the membranes 20 and 21 generally flush with the outer portions of the caps 14 and 15, however the recessed configuration is preferred in order to prevent any accidental movement of the valve stem 23.

I claim:

1. In a gravity timing apparatus in which a flowable material may pass from a first chamber to a second chamber which are generally axially aligned, the improvement comprising, a valve means disposed between said first and second chambers, said valve means defining an opening of a size to normally permit a controlled rate of flow of the material from one chamber to another, and means for selectively shifting said valve means generally axially with respect to said first and second chambers for selectively opening said valve means so as to permit an unobstructed flow of the material from one chamber to another.

2. The gravity timing apparatus of claim 1 in which said means for selectively opening said valve means includes a valve stem extending from said valve means and generally axially with respect to said first and second chambers, said valve stem having outer ends, said first and second chambers having resilient end walls, said outer ends of said valve stem engaging said resilient end walls so a to be movable between said first and second chambers.

3. The gravity timing apparatus of claim 2 including an intermediate passageway between said first and second chambers, said passageway being of reduced dimension relative to said first and second chambers and defining a valve seat, said valve means being normally seated within said valve seat.

4. The gravity timing apparatus of claim 3 in which said valve means includes tapered upper and lower surfaces and an end portion, said end portion being spaced from said valve seat so as to define an open passageway therethrough.

5. The gravity timing apparatus of claim 1 including a passageway between said first and second chambers, said valve means being normally seated within said passageway, said means for selectively opening said valve means includes an elongated valve stem extending from said valve means and generally axially with respect to said first and second chambers, said valve stem having spaced outer ends, cap means for closing each of said first and second chambers, each of said cap means including a generally central resilient portion, said resilient portions being engaged with said outer ends of said valve stem whereby one of said resilient portions may be urged against one of said outer ends of said valve stem to shift said valve means so as to completely open said passageway between said first and second chambers and whereafter the other of said resilient portions will automatically shift said valve stem to return said valve means within said passageway.

6. The gravity timing apparatus of claim 5 in which each of said cap means includes an outer base portion for supporting the apparatus in an upright position, and each of said central resilient portions being recessed toward said first and second chambers with respect to said base portions.

7. The gravity timing apparatus of claim 6 in which each of said central resilient portions includes a socket means, said outer ends of said valve stem being seated within said socket means.

8. In a gravity timing apparatus in which a flowable material may pass from a first chamber to a second chamber through a reduced neck portion all of which are generally axially aligned, the improvement comprising, a valve means normally disposed within the neck portion between said first and second chambers, said valve means defining an opening of a size to normally permit a controlled rate of flow of the material from one chamber to another, whereby each of said first and second chambers has outer resilient end walls, an elongated valve stem extending from said valve means and engaging each of said end walls, said end walls are engagable to selectively shift said valve means generally axially with respect to said first and second chambers for selectively opening said valve means with respect to said neck portion so as to permit an unobstructed flow of the material from one chamber to another.

9. The gravity timing apparatus of claim 8 in which said valve means includes tapered upper and lower surfaces and an end portion, said end portion being spaced from said valve seat so as to define an open passageway therethrough.

10. The gravity timing apparatus of claim 8 including base means for supporting each of said first and second chambers in an upright position, said base means generally encircling said end walls.

* * * * *